United States Patent [19]

Sanford

[11] 3,938,161

[45] Feb. 10, 1976

[54] MICROSTRIP ANTENNA STRUCTURE

[75] Inventor: Gary G. Sanford, Boulder, Colo.

[73] Assignee: Ball Brothers Research Corporation, Boulder, Colo.

[22] Filed: Oct. 3, 1974

[21] Appl. No.: 511,706

[52] U.S. Cl. ..... 343/829; 333/84 M; 343/846; 343/853

[51] Int. Cl.[2] ..... H01Q 9/38

[58] Field of Search ..... 333/84 M; 343/705, 708, 343/826, 827, 829, 846, 848

[56] References Cited

UNITED STATES PATENTS 3,811,128 5/1974 Munson ..... 343/846 X

FOREIGN PATENTS OR APPLICATIONS 798,821 7/1958 United Kingdom ..... 343/708

*Primary Examiner*—Paul L. Gensler
*Attorney, Agent, or Firm*—James D. Haynes

[57] ABSTRACT

A microstrip antenna structure is provided wherein a plurality of relatively narrow elements, resonant in their longer dimensions, are organized into two staggered or offset sets of interleaved elements with each set being fed from opposite sides of the structure through a corporate microstrip feed line from a common feed point. The aligned radiating ends of the two offset sets of elements simulate four line sources of radiation. The preferred embodiment produces an efficient end-fire radiation pattern from this relatively compact structure which may, in turn, constitute an individual end-fire radiator in a larger array structure.

23 Claims, 1 Drawing Figure

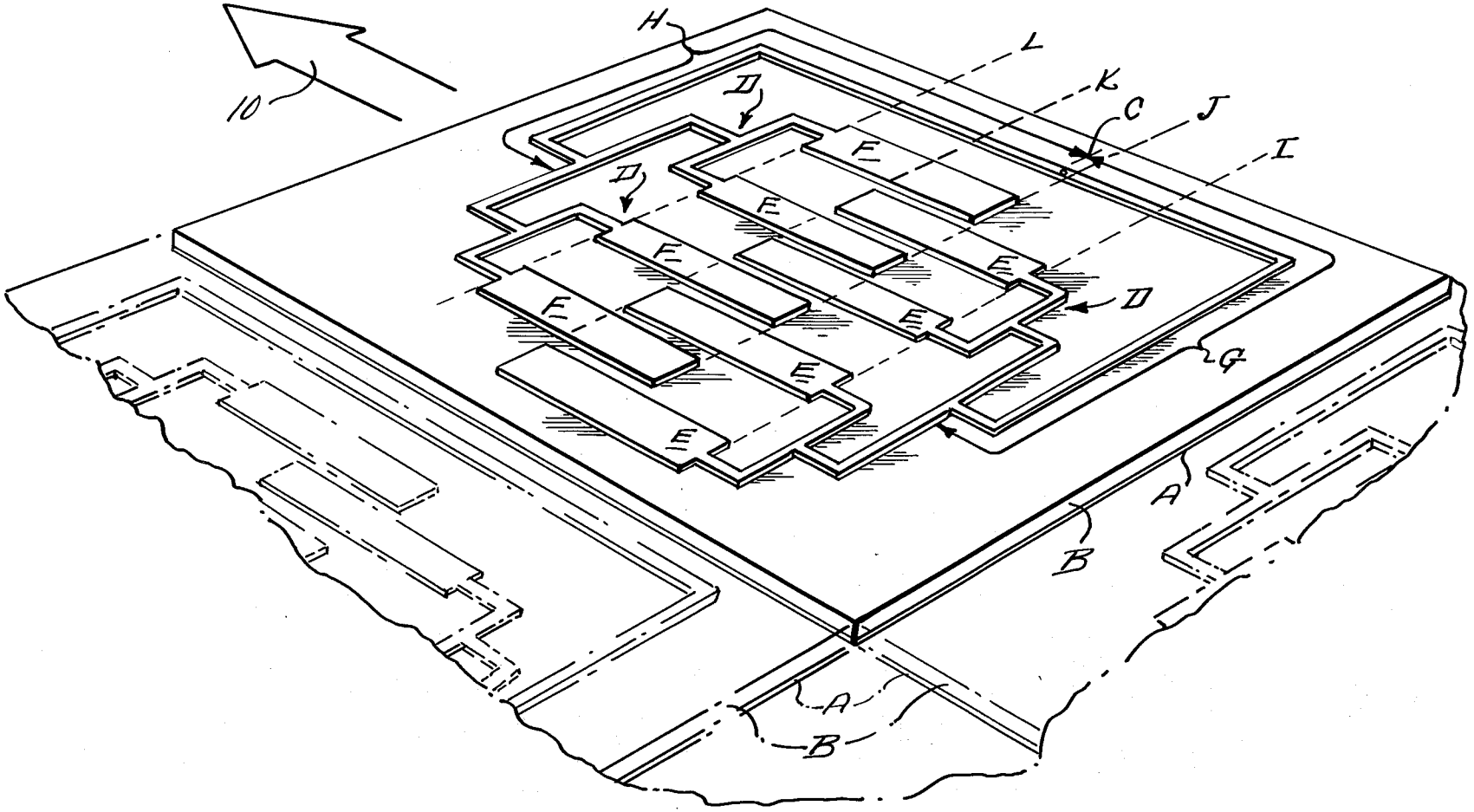
L
K
C
J
I
H
D
D
D
G
F
F
F
F
F
F
E
E
E
E
E
E
A
A
B
B
10

MICROSTRIP ANTENNA STRUCTURE

This invention generally relates to antenna structures for transmitting and/or receiving radio frequency electromagnetic signals. More particularly, this invention concerns a special form of microstrip antenna formed from stock material similar in structure to the conventional printed circuit boards (i.e. a conductor sheet laminated to a dielectric substrate) and formed using, for example, photoresist etch-out processes similar to the conventional printed circuit board processes.

In general, microstrip antennas approach the ideal in conformal, lightweight, mechanically rugged, easily reproduced antenna structures. Background for understanding the basic microstrip antenna radiator structure and operation may be found, for example, in commonly assigned U.S. Pat. Nos. 3,710,338; 3,713,166 and 3,713,162 and patent application Ser. Nos. 99,481 filed Dec. 18, 1970, now U.S. Pat. Nos. 3,810,183; 352,034 filed Apr. 17, 1973, now U.S. Pat. No. 3,811,128 and 352,005 filed Apr. 17, 1973. Microstrip radiating elements have been used to solve many antenna problems. However, their usefulness in, for example, end-fire arrays has been limited because: (1) If quarter wavelength resonant microstrip elements are used, it is necessary to short one edge of the element to ground. This is expensive, less reliable, less repeatable, and at frequencies above 5 GHz very difficult. (2) If half wavelength resonant microstrip elements are used, there is often not enough room to provide the correct element spacing, and there is less energy at low angles for directing into an end-fire beam. (3) If full wavelength or larger microstrip elements are used, there is also often not enough room to provide the correct element spacing.

Microstrip arrays have been designed and fabricated using primarily elements resonant at one-half wavelength in the substrate dielectric. These arrays have been designed with element phases adjusted to steer the beam off boresight. However, when the beam is steered far off boresight, unwanted grating lobes become a problem unless the elements are moved closer together. As the end-fire condition is approached, the elements should be about a quarter wavelength apart. The half wavelength resonant microstrip element on a typical substrate is too large for quarter wavelength spacing, and in any case the half wavelength element tends to radiate less energy at low angles. This is due to the relative phases of the energy radiated from the two edges of the half wavelength microstrip element.

As a result of these considerations, quarter wavelength resonant elements are usually used in microstrip end-fire arrays. This element has only one radiating edge and has the opposite edge shorted to ground. The short is fabricated typically by drilling holes in the substrate material and "plating through" to connect the upper and lower copper laminates. This process is expensive, relatively unreliable, less repeatable, and at frequencies above 5 GHz does not produce a good short.

This invention provides a new microstrip antenna structure which may be used, for example, to provide a compact efficient end-fire microstrip radiator without encountering the difficulties or disadvantages mentioned above with prior attempts to achieve end-fire radiation patterns using microstrip radiator elements. Other uses may also result from my novel antenna structure. However, at present, my preferred and exemplary embodiment of the invention comprises a microstrip end-fire antenna subarray.

This exemplary embodiment is a novel microstrip radiating structure in which a microstrip element resonant at one wavelength is divided into narrow widths in the non-resonant dimension and staggered to produce, in effect, four line sources with the correct spacing and phasing for end-fire radiation.

Among other advantages, this invention eliminates the need to short microstrip elements to ground in an end-fire array. A complete end-fire array can be fabricated in the same way other microstrip arrays are fabricated.

These and other objects and advantages of this invention will be more fully understood by reading the following detailed description in conjunction with the accompanying drawing in which:

The drawing is a diagrammatic perspective view of an exemplary embodiment of this invention. (Additional subarray elements shown in phantom lines are not located to scale with respect to the solid line subarray in the drawing.)

Referring to the drawing, the antenna structure shown in solid lines might itself be called an array, but in most applications it will be combined with similar units (shown by phantom lines in the drawing) to produce a larger array. Therefore, the unit shown is, for convenience, herein called a subarray or more generally, an antenna structure. The subarray is generally typical of all microstrip antennas in that it consists of a conductive foil ground plane A, a dielectric substrate B, and conductors composing the antenna circuit elements D, E and F.

Elements F comprise a first set of elements having first and second radiating ends substantially aligned along first and second lines L and J respectively. Elements E comprise a second set of elements having third and fourth radiating ends substantially aligned along third and fourth lines K and I respectively. These two sets of elements E and F are interleaved so as to sequence the lines in the respective order of L, K, J and I as shown.

Elements D comprise a corporate structured microstrip feed line extending from a common feed point C to the radiating ends of elements F disposed at line L and to the radiating ends of elements E disposed at line I. The distance from the common feed point to the elements F differs from the distance to the elements E so as to introduce a predetermined relative electrical phase relationship therebetween at the nominal operating frequency.

A radio frequency signal is introduced at point C through a coaxial connector mounted on the back of the board. The power is divided equally at this point by the use of properly matched microstrip transmission lines D. (No attempt has been made to show conventional transmission line matching in the drawing.) The power is further subdivided so that all the elements E and F receive equal power.

Since the relative phases of radiated signal along the individual lines I, J, K and L are substantially equal therealong (although different as between the various lines) and since the radiating ends included along these lines are relatively closely spaced compared to the nominal operating frequency wavelength, the net effect of this arrangement is to simulate line sources of coherent radiation along lines I, J, K and L respectively. The lengths of the primary feed-lines are adjusted so that $(G-H) = \pm$ (¼ wavelength in the dielectric) depending on which end-fire beam is desired. Thus for the specific exemplary case of $(G-H) = -$ (¼ wavelength in the dielectric) the phase at line L lags the phase at line I by 90°. However, the radiated phases from these two lines differ by 180° because of their opposed physical configuration so that the radiated phase from line L actually leads by 90°.

The radiating elements are one wavelength long in the dielectric which causes the phase at line K to be the same as the phase at line I. Here again, though, the opposed physical configuration causes the radiated phases to differ by 180°. A similar argument holds for the relationship between lines L and J. The resulting relative radiated phases from the four lines produce end-fire radiation as shown at 10 in the drawing and in particular, these relative phases are:

| | |
|---|---|
| I | 0° |
| J | 90° + 180° |
| K | 0° + 180° |
| L | 90° |

In the exemplary antenna structure, these radiated phases will produce such end-fire radiation under the following conditions:

1. The separations between simulated line sources I, J, K and L must be a quarter wavelength in air. This means that line J must be centered between lines I and K and that line K is centered between lines J and L. Since the length of the resonant axis or longitudinal dimension of elements E and F are determined by the wavelength in the dielectric and since, for this exemplary embodiment, the half length of elements E and F is preferably a quarter wavelength in air (i.e. the space above the radiators) it follows that the relative dielectric constant of the substrate should preferably be 4.0. Other dielectric constants such as between 2.0 and 6.0 could also be used to approximate the optimum end-fire performance obtainable in the preferred embodiment.

2. The center-to-center spacing between the elements E and between the elements F must be small enough so that radiation from lines I, J, K and L appears as radiation from line sources. The separation should preferably be less than a half wavelength in air. On the other hand, it is understood that the separation cannot be so small that the elements become inefficient as radiators. The minimum separation is probably approximately 0.2 wavelengths in air. These preferred separations would thus correspond to a radiator width of approximately 0.1 wavelength to approximately 0.25 wavelength, ignoring for the moment spacing between adjacently positioned elements E and F.

3. The gap between adjacent elements E and F must be wide enough to effectively limit the coupling between the elements. The thickness of the usual dielectric substrate for microstrip antennas is normally a sufficient width for this gap.

Although only one specific presently preferred exemplary embodiment has been described in detail above, those in the art will appreciate that various modifications and variations are possible in this exemplary embodiment without materially departing from this novel antenna structure and the advantages accruing therefrom. Accordingly, all such modifications and variations are intended to be included within the scope of this invention as defined in the appended claims.

What is claimed is:

1. An antenna structure, said structure comprising:

an electrically conductive ground plane surface, a layer of electrically conductive radiator elements having respectively corresponding feed line elements connected thereto, a dielectric substrate having a predetermined thickness disposed between said ground plane surface and said layer, said radiator elements comprising a first set of spaced apart radiators having respectively associated resonant axes directed in a first direction away from the connection of said feed line elements respectively associated therewith and a second set of spaced apart radiators having respectively associated resonant axes directed in a second direction opposite to said first direction away from the connection of said feed line elements respectively associated therewith, the indvidual radiators of said first and said second sets of spaced apart radiators being interleaved, and said feed line elements being connected between a common feed point and the individual ones of said radiator elements to provide electrical signals thereto in a transmit mode and to receive electrical signals therefrom in a receive mode said electrical signals having predetermined relative phase relationships for producing a correspondingly predetermined antenna response pattern.

2. An antenna structure as in claim 1 wherein said layer comprises a unitary and integral electrically conductive layer shaped to define said radiator elements and said feed line elements.

3. An antenna structure as in claim 1 wherein:

said first and second sets of spaced apart radiators comprise individual radiators having a first dimension along their respective resonant axes and a second dimension substantially perpendicular thereto, said first dimension being substantially equal to a first predetermined distance in terms of wavelength of the electrical signals in the dielectric substrate at a predetermined operating frequency and also substantially equal to a second predetermined distance in terms of wavelength of the electrical signals in the area overlying said radiators at said predetermined operating frequency, said first and second sets of spaced apart radiators being interleaved to a depth substantially equal to a third predetermined distance in terms of wavelength of the electrical signals in the area overlying said radiators at said predetermined operating frequency, said first, second and third predetermined distances in terms of wavelength having a predetermined relative relationship.

4. An antenna structure as in claim 1 wherein:

the distances from said common feed point along said feed line elements to each of the individual radiators in the first set of spaced apart radiators are equal to a first dimension, the distance from said common feed point along said feed line elements to each of the individual radiators in the second set of spaced apart radiators are equal to a second dimension, and said first and second dimensions differ by a predetermined number of quarter wavelengths of the electrical signals in the dielectric substrate at a predetermined operating frequency.

5. An antenna structure comprising a plurality of individual structures as in claim 1 disposed in an array of such individual structures.

6. An antenna structure as in claim 1 wherein said feed line element connections to said radiator elements comprise an electrical connection at the outer perimeter of each of said radiator elements along a side intersected by its respectively associated resonant axis.

7. An antenna structure as in claim 6 wherein said feed line elements comprise a corporate structured microstrip feed line.

8. An antenna structure, said structure comprising:

an electrically conductive ground plane surface, a layer of electrically conductive radiator elements having respectively corresponding feed line elements connected thereto, a dielectric substrate having a predetermined thickness disposed between said ground plane surface and said layer, said radiator elements comprising a first set of spaced apart radiators having respectively associated resonant axes directed in a first direction and a second set of spaced apart radiators having respectively associated resonant axes directed in a second direction opposite to said first direction, the individual radiators of said first and said second sets of spaced apart radiators being interleaved, said feed line elements being connected between a common feed point and the individual ones of said radiator elements to provide electrical signals thereto in a transmit mode and to receive electrical signals therefrom in a receive mode said electrical signals having predetermined relative phase relationships for producing a correspondingly predetermined antenna response pattern, said first and second sets of spaced apart radiators comprising individual radiators having a first dimension along their respective resonant axes and a second dimension substantially perpendicular thereto, said first dimension being substantially equal to a first predetermined distance in terms of wavelength of the electrical signals in the dielectric substrate at a predetermined operating frequency and also substantially equal to a second predetermined distance in terms of wavelength of the electrical signals in the area overlying said radiators at said predetermined operating frequency, said first and second sets of spaced apart radiators being interleaved to a depth substantially equal to a third predetermined distance in terms of wavelength of the electrical signals in the area overlying said radiators at said predetermined operating frequency, said first, second and third predetermined distances in terms of wavelength having a predetermined relative relationship, and said first predetermined distance being one wavelength and said second predetermined distance being one-half wavelength and said third predetermined distance being one-fourth wavelength.

9. An antenna structure as in claim 8 wherein said dielectric substrate has a relative dielectric constant of substantially 4.

10. An antenna structure as in claim 8 wherein said dielectric substrate has a relative dielectric constant between 2 and 6.

11. An antenna structure as in claim 8 wherein said second dimension of said radiators is greater than approximately one-tenth wavelength of the electrical signals in the area overlying said radiators at said predetermined operating frequency.

12. An antenna structure as in claim 11 wherein the interleaved individual radiators are spaced one from another by a distance which is at least approximately said predetermined thickness dimension of said dielectric substrate.

13. A microstrip antenna structure for transmitting or receiving electromagnetic radio frequency signals at at least one predetermined operating frequency, said antenna structure comprises:

an electrically conductive ground plane surface;

a dielectric substrate overlying said ground plane, said dielectric substrate having a predetermined thickness and a predetermined relative dielectric constant;

a plurality of substantially rectangularly shaped electrically conductive radiator elements overlying said dielectric substrate;

said rectangular radiator elements having substantially parallel longitudinal axes along respective length dimensions which are resonant at said operating frequency in said dielectric substrate;

said plurality of rectangular radiator elements comprising a first set of elements having first and second radiating ends substantially aligned respectively along first and second lines in the transverse or width dimensions thereof and a second set of elements having third and fourth radiating ends substantially aligned respectively along third and fourth lines in the transverse or width dimensions thereof;

the individual elements of said first and second sets being interleaved and offset with respect to each other so as to sequence said lines in the respective order of first, third, second and fourth, a common feed point, and a corporate structured microstrip electrically conductive feed line extending from the common feed point to the radiating ends of said first set disposed along said first line and also extending from the common feed point to the radiating ends of said second set disposed along said fourth line, the distances along the feed line from said common feed point to the individual elements of the first set differing from the distances along the feed line from said common feed point to the individual elements of the second set by a predetermined amount.

14. An antenna structure as in claim 13 wherein said plurality of radiator elements and said feed line comprise a unitary and integral electrically conductive layer shaped to define said radiator elements and said feed line.

15. An antenna structure as in claim 13 wherein said predetermined amount of difference in the feed line lengths is substantially equal to a predetermined number of quarter wavelengths at said operating frequency in said dielectric substrate.

16. An antenna structure comprising a plurality of individual structures as in claim 13 disposed in an array of such individual structures.

17. An antenna structure as in claim 13 wherein said length and width dimensions, said offsetting said feed line distances and said predetermined relative dielectric constant are adapted to cooperate in effectively simulating the overall effect of four line radiation sources corresponding to said first, third, second and fourth lines with the correct line source spacing and relative phasing to produce an end-fire radiation pattern for said antenna structure.

18. An antenna structure as in claim 13 wherein said length dimensions are substantially equal to one wavelength at said operating frequency in said dielectric substrate.

19. An antenna structure as in claim 18 wherein said predetermined relative dielectric constant is between 2 and 6.

20. An antenna structure as in claim 18 wherein said first, second, third and fourth lines are spaced from one another at intervals substantially equal to one-fourth wavelength at said operating frequency in the space above said radiator elements.

21. An antenna structure as in claim 20 wherein said predetermined relative dielectric constant is substantially 4.

22. An antenna structure as in claim 13 wherein the center-to-center spacing between radiator elements of said sets is greater than approximately two-tenths wavelength at said operating frequency in the space above said radiator elements and less than approximately one-half wavelength.

23. An antenna structure as in claim 22 wherein adjacently located radiator elements are spaced apart by a distance which is at least approximately said predetermined thickness dimension of said dielectric substrate.

* * * * *